US006126023A

United States Patent [19]

Durrant-Whyte et al.

[11] Patent Number: 6,126,023

[45] **Date of Patent: *Oct. 3, 2000**

[54] CRANE WITH IMPROVED REEVING ARRANGEMENT

[75] Inventors: Hugh Durrant-Whyte; Gamini Dissanayke; David C. Rye, all of Sydney, Australia

[73] Assignees: The University of Sydney; Patrick Stevedores Holdings Pty. Limited, both of Sydney, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/077,216

[22] PCT Filed: Nov. 22, 1996

[86] PCT No.: PCT/AU96/00749

§ 371 Date: Jul. 8, 1998

§ 102(e) Date: Jul. 8, 1998

[87] PCT Pub. No.: WO97/19888

PCT Pub. Date: Jun. 5, 1997

[30] Foreign Application Priority Data

Nov. 24, 1995 [AU] Australia ..... PN6811

[51] Int. Cl.[7] ..... B66C 17/20

[52] U.S. Cl. ..... 212/274; 212/323; 294/81.4

[58] Field of Search ..... 212/274, 320, 212/323, 345; 294/81.3, 81.4

[56] References Cited

U.S. PATENT DOCUMENTS

| | | |
|---|---|---|
| 2,916,162 | 12/1959 | Gercke . |
| 3,081,884 | 3/1963 | Minty . |
| 3,276,602 | 10/1966 | Vogeley et al. . |
| 3,309,966 | 3/1967 | Fawell . |
| 3,476,263 | 11/1969 | Komatsu et al. . |

(List continued on next page.)

FOREIGN PATENT DOCUMENTS

| | | |
|---|---|---|
| 0 246 922 | 11/1987 | European Pat. Off. . |
| 2014 656 | 3/1970 | Germany . |
| 3737 082 A1 | 5/1989 | Germany . |
| 4005 194 A1 | 8/1990 | Germany . |
| 2 162 146 | 1/1986 | United Kingdom . |

OTHER PUBLICATIONS

*Journal of Offshore Mechanics and Arctic Engineering*, Stiffness Study of a Parallel Link Robot Crane for Shipbuilding Appliances, N.G. Dagalakis et al., Aug. 1989, vol. 111, pp. 183–193.

*Journal of Robotic Systems*, The Nist Robocrane, James Albus, et al., 10(5), 709–724 (1993).

*Primary Examiner*—Thomas J. Brahan
*Attorney, Agent, or Firm*—Darby & Darby

[57] ABSTRACT

A crane arranged through its reeving system to manoeuver a load. The crane includes an upper support structure, a lower support structure arranged to carry a load and six reeving cables suspending the lower support structure from the upper support structure. Means are provided for changing the effective length between the upper and lower support structure of selective ones of the reeving cables. The reeving cables are arranged such that they are connected geometrically to the upper and lower support structures at apexes of an upper and a lower quadrilateral plane figure, respectively. The reeving cables are arranged such that the cables of a first pair of the reeving cables converge in a downward direction, the cables of a second pair of the reeving cables converge in an upward direction, and the cables of the third pair of reeving cables extend between opposite ends of the first and second pair reeving cables at the upper and lower support structures. A crane with such reeving arrangement enables adjustment of the position and altitude of the lower support structure with respect to the upper support structure by manipulating the length in individual reeving cables. The reeving cable arrangement results in "stiffness" between the upper and lower support structures when all cables are in tension.

19 Claims, 8 Drawing Sheets

U.S. PATENT DOCUMENTS

| | | | |
|---|---|---|---|
| 3,532,324 | 10/1970 | Crittenden | 294/81.4 |
| 3,567,040 | 3/1971 | Thomson . | |
| 3,842,986 | 10/1974 | Hupkes | 212/274 |
| 3,874,516 | 4/1975 | Watanabe | 212/323 |
| 3,945,503 | 3/1976 | Cooper . | |
| 4,350,254 | 9/1982 | Noly . | |
| 4,905,848 | 3/1990 | Skjonberg | 212/274 |
| 5,257,891 | 11/1993 | Baumann et al. . | |

CRANE WITH IMPROVED REEVING ARRANGEMENT

TECHNICAL FIELD OF THE INVENTION

This invention relates to a crane which is arranged through its reeving system to manoeuvre a load.

The invention has been developed in the context of a gantry crane for use in handling shipping containers and the invention will hereinafter be described below in such context. However, it will be understood that the invention does have broader application, to other crane types which are required to exercise stable control over position and orientation of suspended loads.

BACKGROUND OF THE INVENTION

Special purpose container handling cranes are used in modern cargo handling facilities to load and off-load ships, and the speed with which ships may be serviced by such cranes is a key determining factor in the overall efficiency of a port. Current gantry cranes use a head block to grapple a container by way of a spreader. The head block is suspended from a rail mounted gantry trolley through an arrangement of reeving cables used to raise and lower the head block.

The cycle times of gantry cranes are limited by two main factors. Firstly, containers may not always be aligned in such a way as to allow easy positioning of the spreader on top of a container that is to be lifted. Thus, the speed with which the spreader may accurately be positioned by the crane is of considerable importance. Typically, this positioning may take up to 50% of the duty cycle of the crane, the remainder being taken up by travel between ship and shore. Secondly, the head block and load suspended from the reeving, at heights sometimes up to 50 m, have the tendency to sway or swing during motion of the crane and during hoisting operations. These factors can reduce so-called box rates and, hence, port efficiency by about 50%. Considering that a typical container ship may require up to 1,000 container movements, potential benefits of improving crane efficiency are substantial.

Reducing the sway of the crane hoist and making the reeving more controllable will result in reduced positioning times and improved ship service times. A reduction in positioning time of the order of 10–20% would have a substantial impact on the cargo handling business.

Shipyard and quay-side cranes that currently are employed are stable only in the vertical, z-direction. Loads carried by such cranes may be caused to rotate and sway under lateral forces.

Industrial practice currently employed to improve the operating efficiency of such cranes relies on using the skill of the crane driver to avoid load sway and on the use of complex anti-sway systems. Such systems usually employ complex reeving arrangements and active control systems for hoist motors.

Two such active sway suppression systems are disclosed in U.S. Pat. No. 2,916,162 and U.S. Pat. No. 4,350,254. The former system tends to suppress the pendulum motion in the horizontal direction but fails to suppress any pitch, roll or yaw of the load. The latter system employs additional wires and winches.

A number of studies have been conducted toward achieving more effective reeving arrangements.

One such study has been published by N. G. Dagalakis et al in an article entitled "Stiffness Study of a Parallel Link Robot Crane for Ship Building Applications", Journal of Offshore Mechanics and Arctic Engineering, August 1989, Volume lll, pages 183–193. A further study has been published by James Albus et al under the title "The NIST robot crane", Journal of Robotic Systems, 10(5), 1993,pages 709–724.

Both of these studies disclose cranes having improved hoist and reeving arrangements incorporating the concept of an inverted Stewart Platform of the type commonly used in aircraft simulators. In the cranes by Albus and Dagalakis, the parallel links between the base and the supported load of a Stewart platform are replaced by the reeving cables of the crane, and winches are used as the actuators.

The hoist and reeving designs proposed by Dagalakis and Albus involve the provision of connection points for the reeving on a lower load platform at the vertices of an equilateral triangle. In a similar fashion, connection points for the reeving on the crane trolley are arranged at the vertices of an equilateral triangle. Six reeving cables run from the trolley to the lower load platform, two being connected at each vertex of each triangle. As viewed in plan from above, the upper and lower triangles are rotated through 180° about a vertical axis with respect to one another, so that the vertices of the lower triangle are positioned to align with the mid points of the sides of the upper triangle.

It can be shown that the reeving arrangement disclosed by Dagalakis and Albus will be capable of supporting a load while maintaining tension in all cables, so as to provide stable positional control of the load, only when the centre of mass of the load is contained within the geometric triangle whose apexes are fixed by the location of the sheaves on the lower load platform. It can also be shown that in order to provide stable positional control, the radius of the circle circumscribing the triangular sheave arrangement on the lower load platform will be approximately 1.2 m for a load platform or head block which is arranged to support a 2.4 m wide ×3.0 m high ×12.0 m long standard container. Similarly, it can be further shown that the radius of the circle circumscribing the triangular sheave arrangement on the trolley will then be approximately 2.4 m.

These geometrical constraints in turn establish an allowable eccentricity of the centre of mass of a load contained in a standard container suspended by such reeving arrangement of ±0.6 m in the lateral direction (along the gantry on which the trolley is moveable) and ±0.7 m in the longitudinal direction (direction perpendicular to the gantry). These figures translate to an allowable centre of mass eccentricity of 24% and 6% in the lateral direction and longitudinal direction, respectively. While the allowable lateral eccentricity of 24% is greater than the typical industrial standard specification of 10%, the 6% eccentricity in longitudinal direction does not meet the industry standards.

The present invention seeks to minimise the above mentioned difficulties.

SUMMARY OF THE INVENTION

Broadly defined, the invention provides a crane which comprises an upper support structure, a lower support structure arranged to carry a load, six reeving cables suspending the lower support structure from the upper support structure, and means for changing the effective length between the upper and lower structures of selective ones of the reeving cables. The reeving cables are connected geometrically to the upper and lower support structures at apexes of respective quadrilateral plane figures, such as trapeziums having no parallel sides or trapezoids having one pair of parallel sides. The reeving cables being arranged such that the cables of a first pair of the reeving cables converge in a downward direction, the cables of a second pair of the reeving cables converge in an upward direction and the cables of the third pair of reeving cables extend between opposite ends of the first and second pair of reeving cables at the upper and lower structures.

The terms "trapezium", "trapezoid" and "regular trapezoid" as used in the preceding and following pages of this specification are applicable to geometrical forms (not physical elements) which determine the apex positions for connections between the reeving and the upper and lower support structures. Also the terms are to be understood as having the following meanings:

Trapezium: A quadrilateral plane figure which is not a parallelogram and has no parallel sides.

Trapezoid: A quadulatural plane figure having one pair of parallel sides.

Regular trapezoid: A trapezoid that is symmetrical about an axis that intersects the two parallel sides.

A crane with the reeving arrangement as defined above allows for controllable adjustment of the position and attitude of the lower support structure with respect to the upper support structure by manipulating the length in individual reeving cables in a predetermined manner. The reeving cable arrangement results in "stiffness" being present in the connection between the upper and lower support structures when all cables are in tension, so that the lower support structure and a load attached thereto will follow the motion of the upper support structure. Sway is constrained during hoisting operations.

By locating the connection of the reeving cables at the apexes of a trapezium on the lower and upper support structures, it is possible to maximise the area within which the centre of mass of a suspended container may be contained, thus maximising the allowable centre of mass eccentricity.

In a preferred embodiment of the invention, the reeving cables are connected geometrically at points in the upper and lower support structures which coincide with the apexes of respective trapezoids, and most preferably with the apexes of respective regular trapezoids. The respective trapezoids defined by the locations of the connection points at the upper and lower support structures preferably are similar in shape, and the area bounded by the connection points at the upper support structure preferably is larger than the area bounded by the connection points at the lower support structure.

In a particularly preferred form of the invention the trapezoids are dimensioned such that the distance between the apexes at the shorter parallel side of the upper trapezoid is equal to that of the shorter parallel side of the lower trapezoid. Further, the distance between the apexes at the longer parallel side of the lower trapezoid is chosen to be equal to the distance between the apexes at the shorter parallel sides plus $\sqrt{3}R$, where R is the radius of a circle circumscribing an equilateral triangle with a side length equal to the distance between the apexes of the non-parallel sides of the lower trapezoid. The distance between the apexes at the longer parallel side of the upper trapezoid is then chosen to be equal to the distance between the apexes at the shorter parallel sides plus $2\sqrt{3}R$, the shorter parallel side of the lower trapezoid being located overhead the parallel side of the lower trapezoid.

With these dimensional constraints it is feasible to control the movement of the lower support structure relative to the upper support structure in a manner such that movement about any one axis may be effected without inducing movements about either of the other orthogonal axes.

In a quay-side application of the crane for hoisting containers, the upper support structure may comprise a trolley arranged for reciprocating linear movement along a gantry or boom structure of the crane. The lower support structure may be provided by a head block to which a container may be coupled by a spreader.

The means for changing the effective length between the upper and lower support structures of each of the reeving cables may comprise a plurality of hoist drums, one for each of the reeving cables. The hoist drums may be driven by individual motors or by a common motor to effect fine attitude control of the lower support structure with respect to the upper structure. In the latter case, a transmission system will be provided to effect differential movement of individual hoist drums and the transmission may either be mechanical or hydraulic.

Alternatively, the means for changing the effective length between the upper and lower structures of each of the reeving cables may comprise a single motor-driven hoist drum for all of the reeving cables. Then, adjusting means will be interposed in the path of each reeving cable to provide for additional individual adjustment of the length of each of the reeving cables. Preferably, the adjusting means will comprise electric, hydraulic or pneumatically activated rams.

The hoist drum(s) may be mounted on the upper support structure of the crane or, preferably, be mounted in a drive compartment of the crane so as to reduce the mass carried by the upper support structure.

The crane may further comprise an electronic controller arranged to provide control commands operative on the means for changing the effective length of the reeving cables to adjust and maintain a predetermined length and tension of each of the reeving cables associated with a predetermined spatial attitude or orientation of the lower support structure.

The crane may further be provided with sensor means for determining the spatial position and three-dimensional orientation of the lower support structure within a Cartesian coordinate system and about the x-y-z-axis, wherein the z-axis is the vertical, with respect to the upper support structure. Preferably, feed back means are arranged to transmit to the electronic controller the position and orientation in space of the lower support structure with respect to the upper support structure determined by the sensor means. The electronic controller may be arranged to fine adjust the position and orientation of the lower support structure in response to feedback data provided by the feed back means.

The electronic controller may also be arranged to automatically respond to the feedback means in that the means for changing the effective length of the reeving cables are controlled to automatically counter externally applied forces, such as wind loads, to which the load carried by the lower support structure may be subjected.

The sensor means may preferably include an inertial platform consisting of gyroscopes and acceleratometers disposed on the lower support structure.

The electronic controller may also be arranged to automatically adjust the length of the reeving cables through the means for changing the length of the reeving cables when receiving feedback data indicative of an abnormal position or orientation of the load.

The crane as above defined in its different embodiments provides for an increased stiffness of the reeving cable arrangement to minimise load sway. The proposed reeving arrangement enables full constrainment of the load in space. Load displacements will cause elastic deformation in the reeving cables resulting in large restoring forces which move back and maintain the load in its stable position and orientation determined by the length of each of the tensioned reeving cables. The above described reeving cable arrangement further enables to provide fine positional and attitudinal control of the load in space without movement of the upper support structure.

The invention will be more fully understood from the following description of preferred, exemplary embodiments of the invention. The description is provided with reference to the accompanying drawings.

PREFERRED MODES FOR CARRYING OUT THE INVENTION

Figure 1:
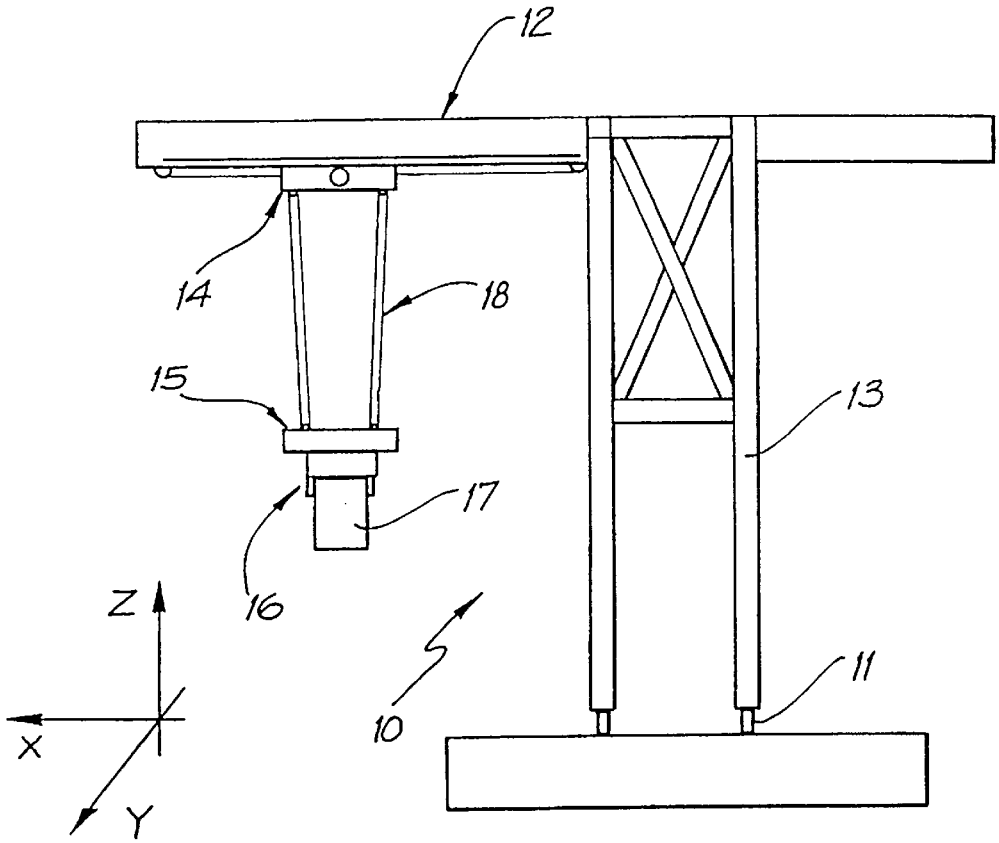
FIG. 1 shows a schematic illustration of a gantry-type crane.

In the drawings the same reference numerals have been used in the various ones of the Figures to denote and refer to functionally equivalent components.

FIG. 1 illustrates schematically a quay-side gantry type crane 10 for transporting containers to and from a ship moored at a pier. The crane 10 comprises a tower structure 13 which is movable on a track 11 in a direction perpendicular to the plane of drawing along the quay in direction of the y-axis. The tower structure 13 supports a gantry 12 which carries a rail mounted trolley 14 which can reciprocate in a direction of the x-axis perpendicular to the axis of movement of the tower structure 13. A reeving arrangement 18 comprising six cables and a supported head block 15 ("the hoist") is suspended from the trolley 14 for upward and downward movement along the z-axis perpendicular to the x-y plane. The hoist 15 has three translational degrees of freedom provided by the trolley movement, tower movement and by adjusting the length of the cables of the reeving 18 along the z-axis. Underneath the head block 15 is disposed in known manner a spreader 16 adapted for engaging containers 17 to be unloaded and loaded from and onto a ship (not illustrated). The basic concept of such a crane, its drive mechanisms and controls as well as the specific components, but for the reeving arrangement described below, are known in the art and will not be further described.

Figure 2:
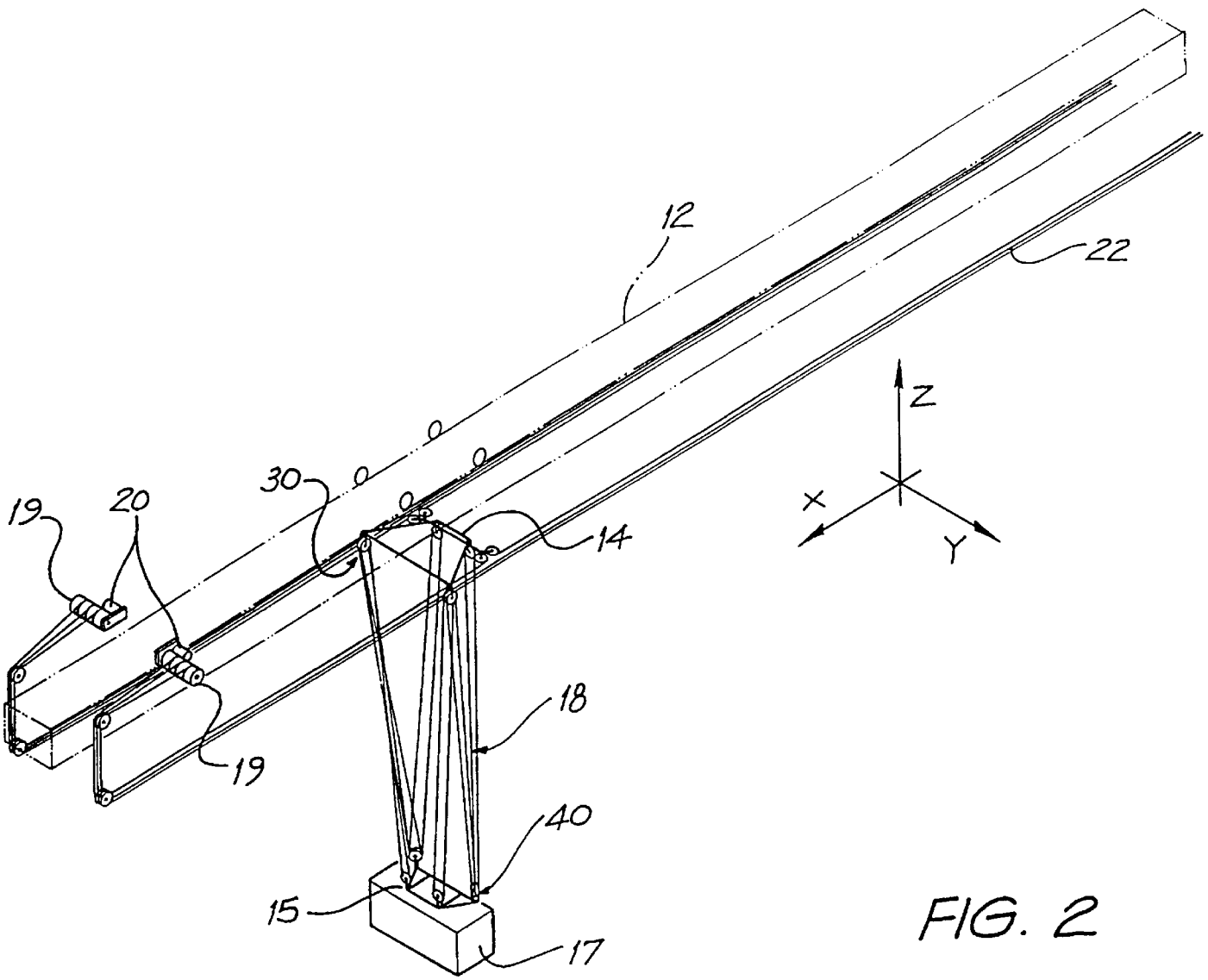
FIG. 2 shows in perspective, a simplified illustration of the gantry and hoist of the crane of FIG. 1, and in which a first form of hoist cable drive arrangement is illustrated.
Figure 4:
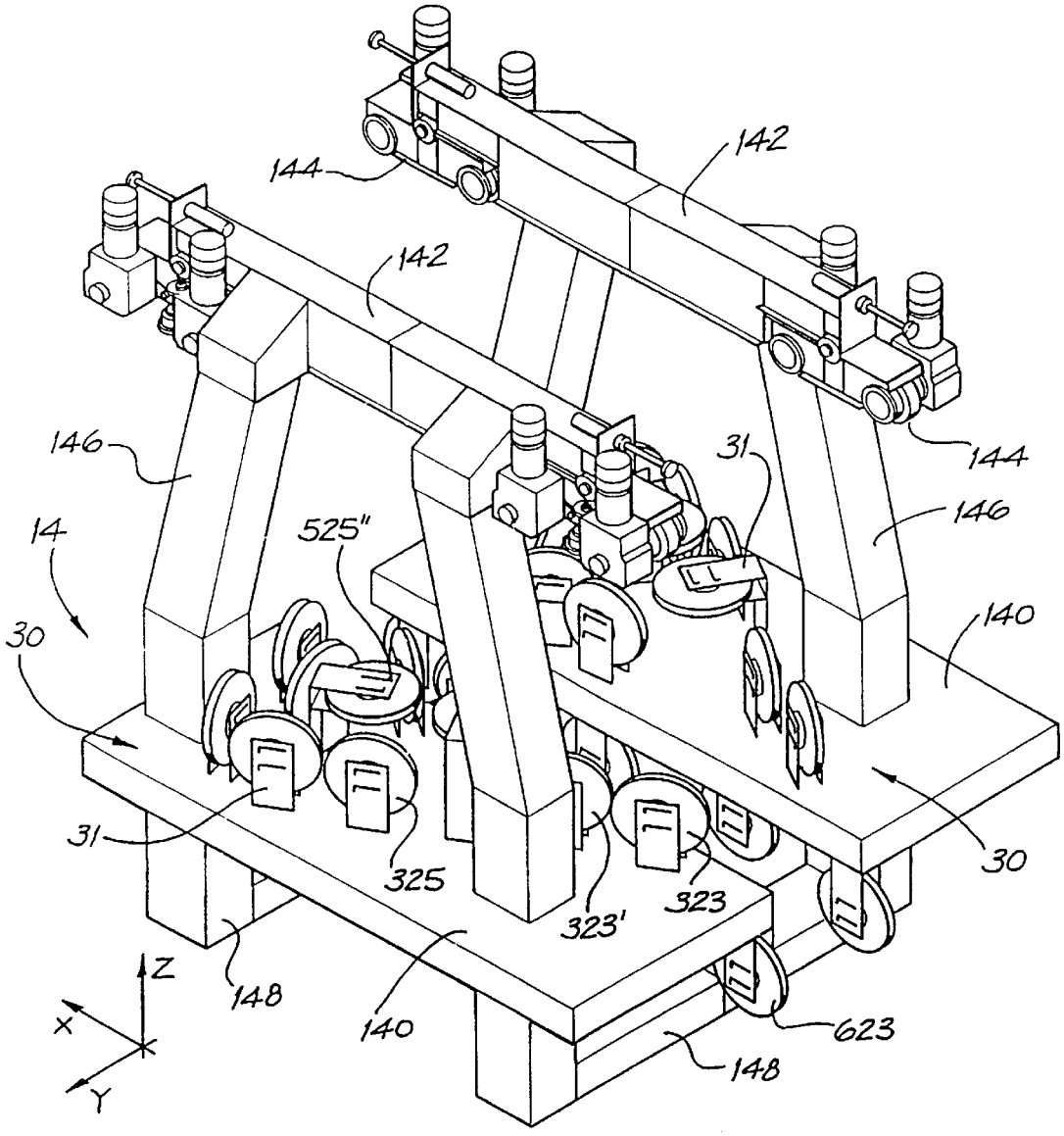
FIG. 4 shows an overhead perspective view of a gantry trolley as shown in FIG. 3 and illustrates one sheave arrangement for guiding reeving cables on the trolley.
Figure 5:
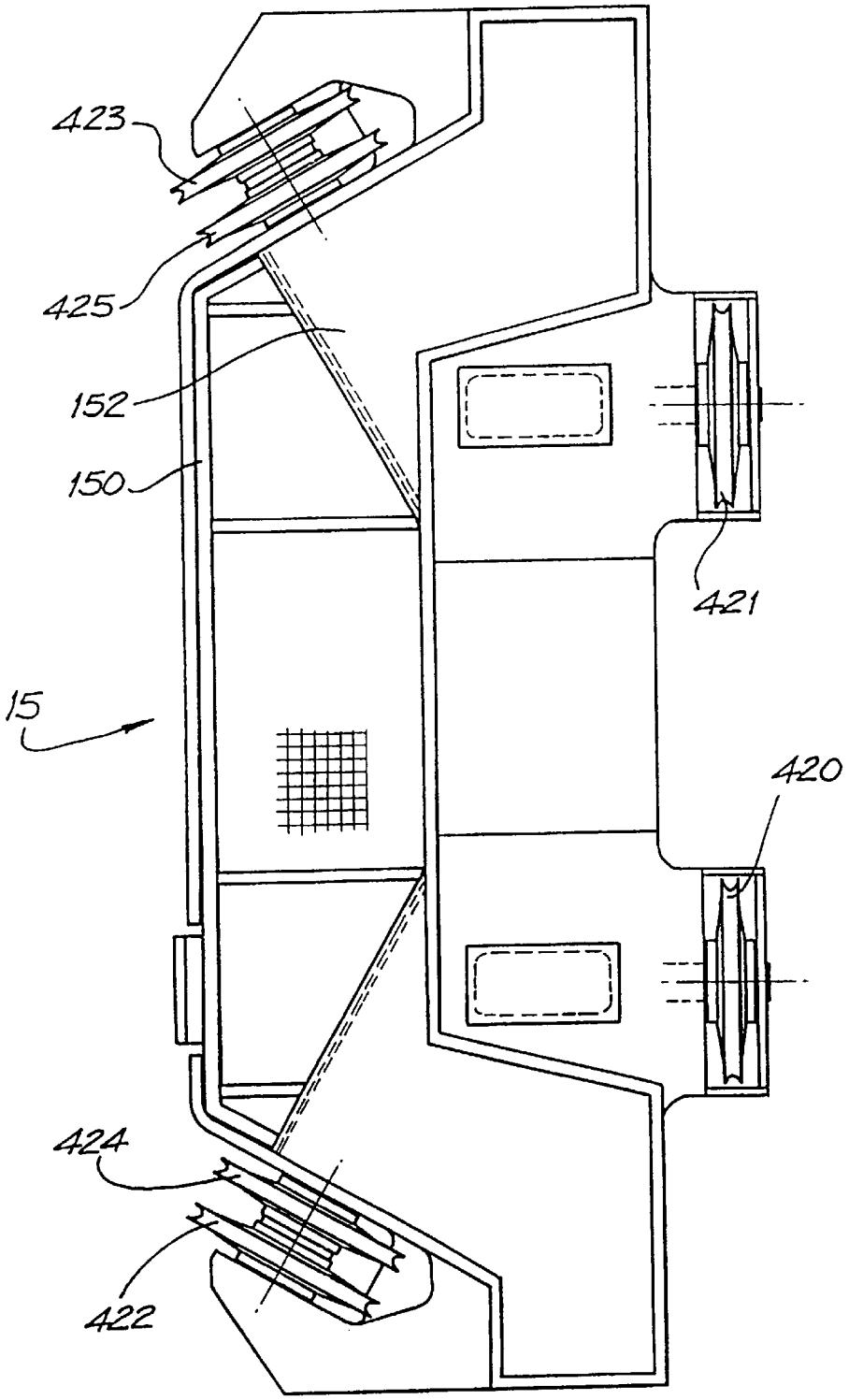
FIG. 5 shows an overhead plan view of a head block of the crane which is illustrated in FIG. 3, and which mounts a set of return sheaves for the reeving cables.

FIG. 2 shows in a perspective schematic illustration the gantry 12 and the reeving configuration 18 of the crane 1. The head block 15 and the gantry trolley 14 are illustrated in principle only and other crane components have been omitted from FIG. 2 for clarity of illustration purposes. On the other hand, FIGS. 3, 4 and 5 show in more detail specific embodiments of a gantry trolley 14 and a head block 15 which can be used in the crane illustrated in FIG. 1.

Turning back to FIG. 2, a first type of hoist cable drive arrangement is shown which includes a total of six hoist drums and their respective drives.

A total of six reeving cables, designated by numeral 22 are provided to form the reeving 18. One end of each of the cables 22 is fixed at the end of the boom in a known manner (not illustrated), whereas the other ends are received on a respective hoist drum 19. Three hoist drums 19 are arranged on either side of the gantry 12 in the hoist cable drive arrangement illustrated in FIG. 2. The hoist drums 19 are driven by conventional motors 20 through a known drive train configuration including gear boxes. The hoist drums 19 can either be driven individually or synchronously so as to lengthen or shorten the individual cables 22 conjunctively or differentially.

Figure 3:
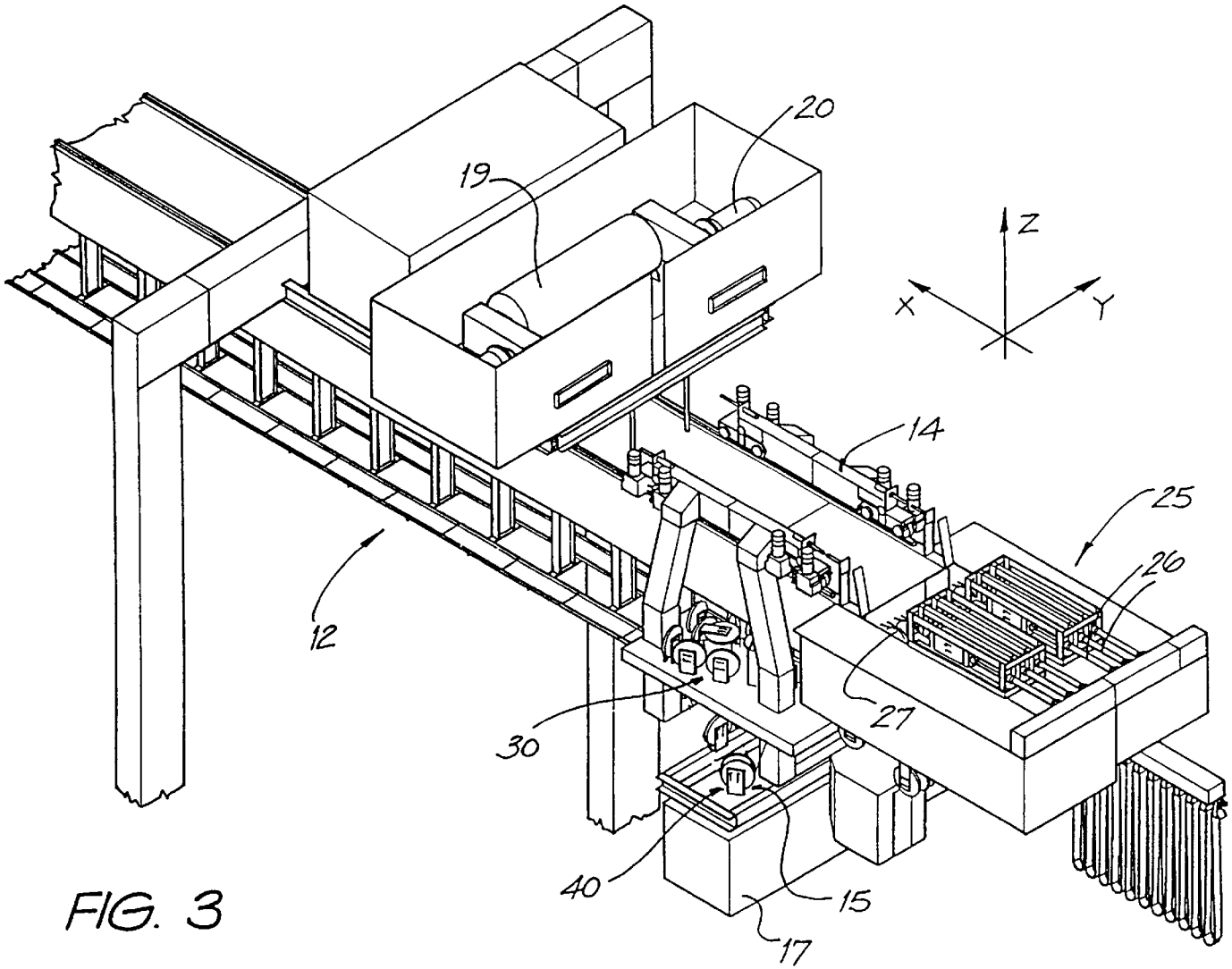
FIG. 3 shows in perspective, a more detailed overhead view of the gantry of FIG. 2, and in which a second type of hoist cable drive arrangement is illustrated.

In contrast to the hoist cable drive arrangement illustrated in FIG. 2, in the hoist cable drive arrangement of FIG. 3 there is provided a common hoist drum 19 on which all ends of the six cables 22 (not illustrated in FIG. 3) are received. The other ends of the cables are fixed as above described at the opposite end of the boom. The common hoist drum 19 is arranged overhead and supported on the gantry 12 near the free distal end thereof. The hoist drum 19 is driven by a conventional motor 20 through a known reduction gear drive train configuration. Since this hoist drum 19 can only be driven such as to lengthen or shorten the individual cables conjunctively, there is provided a mechanism, generally indicated at 25, arranged to adjust or vary the length of individual reeving cables to provide for full positional and attitudinal control of the head block 15 with respect to the gantry trolley 14 as will be described below. The adjustment mechanism 25 for changing the effective length of the cables incorporates six individual rams 26, one from each cable, which may be electrically, hydraulically or pneumatically driven. A cable guiding sheave 27 is mounted on the reciprocating drive rod of each ram 26 to loop each cable.

Figure 7:
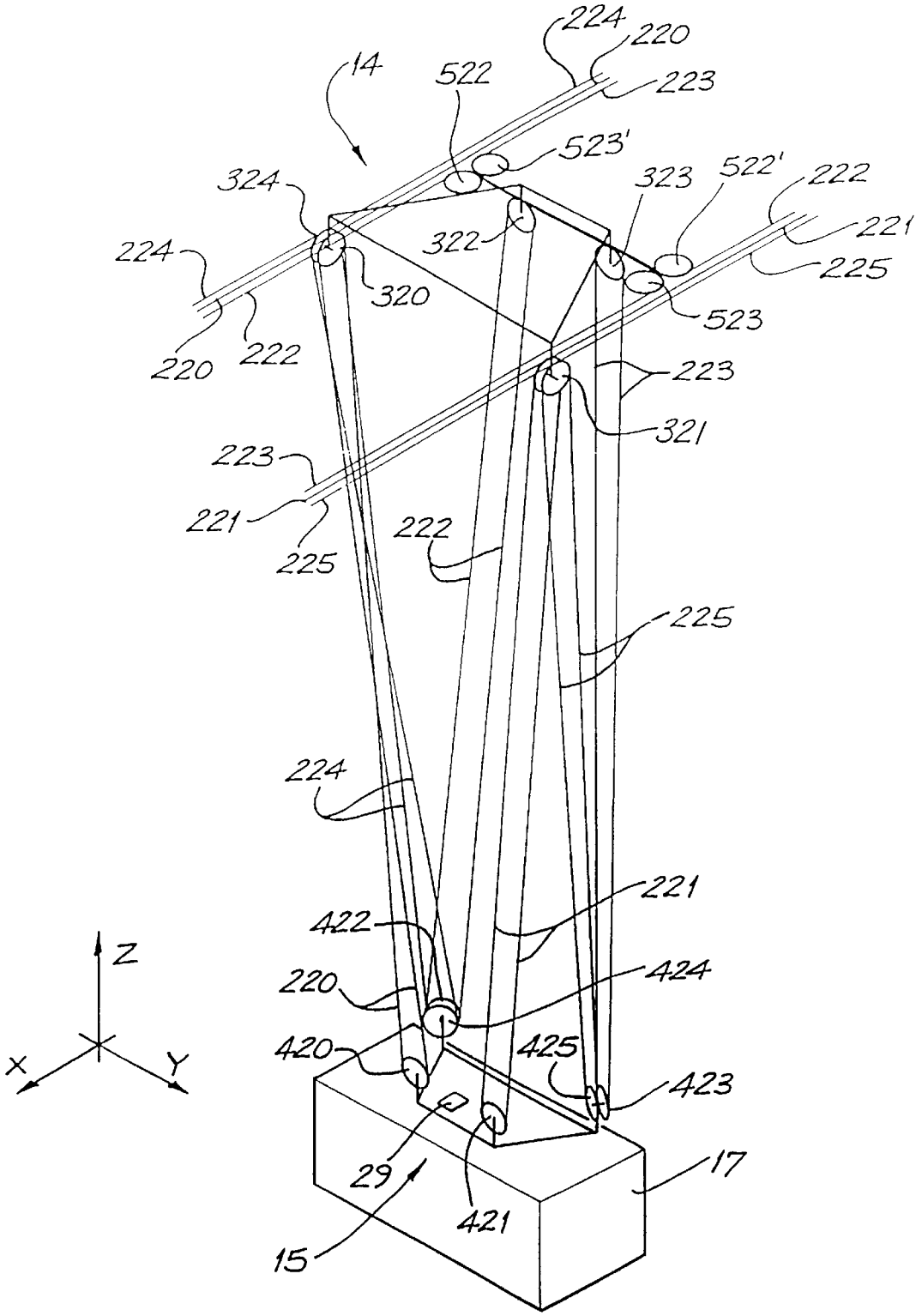
FIG. 7 shows a diagrammatic illustration of the reeving cables extending between the gantry trolley and the head block of the crane illustrated in FIGS. 1 and 2.

Having regard in particular to FIGS. 2 and 7, the cables of the reeving 18 run in sheave and pulley arrangements at the upper trolley 14, generally indicated by numeral 30 in FIG. 2 and at the head block generally indicated by numeral 40. The sheave and pulley arrangement is indicated by numerals 320–325 and 521–525 and 621–625 in the trolley illustrated in FIGS. 3, 4, 7 and 8, and by numerals 420–425 in the head block of FIGS. 3, 5 and 7. This however, will be described in more detail below.

In order to facilitate the understanding of the basic geometric configuration of the reeving 18, reference will be made first to FIG. 6 which shows a geometrical representation of the crane as illustrated in FIGS. 2 and 3.

Figure 6:
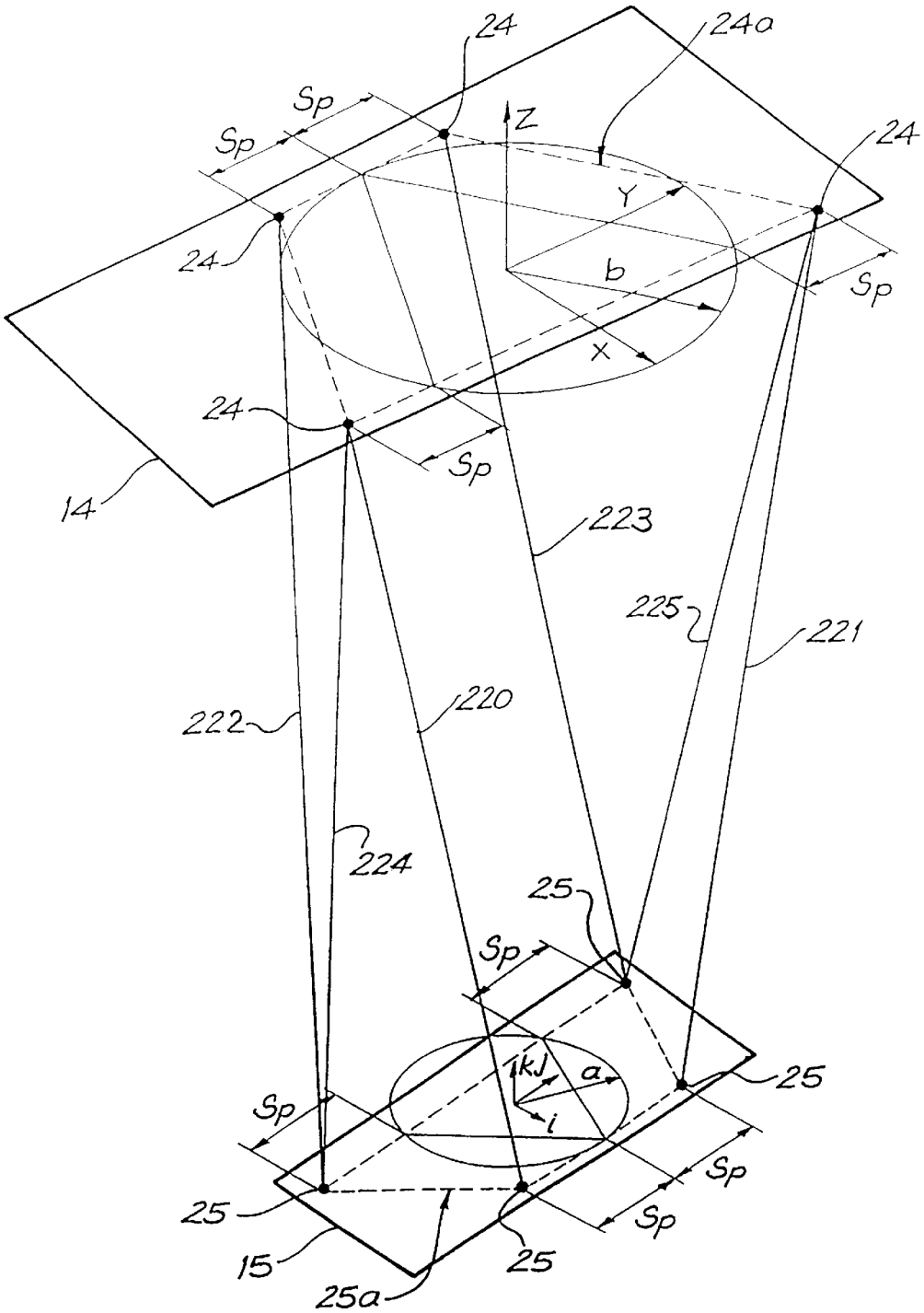
FIG. 6 shows a geometrical representation of the crane as illustrated in FIGS. 2 and 3.

As can be seen in FIG. 6, the head block 15 is connected geometrically to the support plate or structure of the trolley 14 by way of apexes 24 and 25 of regular, trapezoids 24*a* and 25*a*, respectively. The shorter sides of the trapezoids 24*a* and 25*a* are orientated in opposite directions. The lower trapezoid 25*a* is smaller than the upper trapezoid 24*a*. Having regard to the actual reeving configuration illustrated for example in FIG. 7 and constraints imposed by the actual space and mounting requirement for physical guide sheaves carrying the physical reeving cables 22, the sheaves will be mounted on the support structure of the upper trolley 14 and the head block 15, respectively, in such a manner, that the cable runs will coincide as close as physically possible with the apex points of the trapezoids 24*a* and 25*a* illustrated in FIG. 6.

A first pair of reeving cables 220 and 221 extend from the corner points 25 of the shorter parallel side of the lower trapezoid 25*a* in a diverging path towards the corner points 24 of the longer parallel side of the upper trapezoid 24*a*. In the physical reeving configuration illustrated in FIG. 7, each cable includes two falls per cable guided around respective sheaves 320 to 325 and 420 to 425 on the upper and lower support structure, respectively, as will be described below. A second pair of the reeving cables 222 and 223 extend from the corner points 25 of the longer parallel side of the lower trapezoid 25*a* in a converging path towards the corner points 24 of the shorter parallel side of the upper trapezoid 24*a*. The third pair of reeving cables 224 and 225 extend between respective opposite lower and upper ends of the first and second pair of reeving cables 220, 221 and 222, 223 at the corner points 24 and 25 of the lower and upper trapezoid 24*a* and 25*a*. In other words, the third pair of reeving cables 224 and 225 extend between the corner points 25 and 24 of the longer parallel sides of the lower and upper trapezoids 25*a* and 24*a*, respectively. As can be seen further in FIG. 6, none of the reeving cables 220 to 225 intersect each other between the upper and lower trapezoids 24*a* and 25*a* and no two of the reeving cables 220 to 225 extend parallel to one another.

As will be appreciated, it is possible to entirely define the geometry of a regular trapezoid by providing the value of the radius of a circle circumscribing an equilateral triangle having the same side length as the non-parallel sides of the trapezoid, and the value of the length of the shorter parallel side; the value of the length of the longer parallel side being equal to the length of the non-parallel side plus the shorter parallel side. If, like in the illustrated preferred geometrical configuration, the lower and upper trapezoids are regular, the upper trapezoid can be equally defined by a shorter parallel side having the same length as the shorter parallel side of the lower trapezoid and a radius of an equilateral triangle which has an area which is bigger than the lower triangle. Thus, in FIG. 6 are indicated the respective radii a and b of the defining circumscribing circles of the lower and upper trapezoids, respectively, as well as the shorter parallel side distance between apexes, 2Sp.

With these dimensional constraints the effective length of the reeving cables 220 to 225 between the head block 15 and trolley 14 will be identical when the head block 15 and the trolley 14 are in horizontal planes parallel to one another.

The reeving configuration illustrated enables stable and controllable constraint of the head block 15 with respect to the trolley 14 in x, y and z directions and about the x, y and z axes, that is with respect to rolling, pitching and yawning, respectively.

What is more, the reeving arrangement 18 of FIG. 6 as physically embodied in the actual configuration illustrated in FIG. 7, is a symmetric reeving which in the present context means that when all the cables are shortened by the same amount, the lower head block 15 and a container 17 attached thereto will rise and fall along the z-axis with respect to the trolley 14 without changing the position of the container 17 along the x-and y-axis nor changing the orientation or attitude of the container 17 about the x-, y- and z-axis (roll, pitch and yawn), On the other hand, by shortening or lengthening one or more of the reeving cables 220 to 225 and maintaining or adjusting the tension in the other cables, it is possible to induce a controlled and prescribed change in position and/or attitude of the head block 15 with respect to the trolley 14 and maintain such position and attitude while moving the crane 10 as a whole or the trolley 14 along the gantry 12 as has been described above. This latter type of adjustment is used for overall positioning while the former can be used to fine position the container without the trolley 14 having to be moved.

It is possible to provide basic equations that reflect the geometrical relations between the eight apexes of the two trapezoids in space and the relative movement of the lower trapezoid with respect to the upper trapezoid (that is relative movement of the head block with respect to the trolley). Having reference to FIG. 6, if the origin of the orthogonal coordinate system x, y, z is located in the centre of the upper circumscribing circle with radius b, which together with Sp defines the upper trapezoid, and the spatial orientation of the lower trapezoid is defined by the Euler angles $\phi$, $\theta$ and $\psi$, which respectively provide the rotational attitude about the i, j, k axes of the lower Cartesian coordinate system which system is fixed with respect to the lower trapezoid in the centre of the circumscribing circle with radius a of the lower trapezoid. Equations are established to define the effective length i of each of the reeving cables 220 to 225 as a function of the Euler angles, trapezoid geometry parameters a, b and Sp and displacement of the centre of the lower Cartesian coordinate system i, j, and k with respect to the upper Cartesian coordinate system x, y and z.

These equations are provided as follows:

$$l_{226}^2 = \left(s_p + \frac{a\sqrt{3}}{2}\right)^2 + z^2 + \left(\frac{b}{2} - x\right)^2 + \left(s_p + \frac{b\sqrt{3}}{2} - y\right)^2 + 2\left(s_p + \frac{a\sqrt{3}}{2}\right)z\sin(\phi)\cos(\theta) +$$

$$2\left(s_p + \frac{a\sqrt{3}}{2}\right)\left(\frac{b}{2} - x\right)(\sin(\psi)\cos(\phi) - \sin(\phi)\sin(\theta)\cos(\psi)) +$$

$$\frac{a\left(a + 4z\sin(\theta) + 2\cos(\psi)\cos(\theta)(b - 2x) + 2\sin(\psi)\cos(\theta)\left(b\sqrt{3} + 2s_p - 2y\right)\right)}{4} -$$

$$2\left(s_p + \frac{a\sqrt{3}}{2}\right)\left(s_p + \frac{b\sqrt{3}}{2} - y\right)(\cos(\phi)\cos(\psi) + \sin(\phi)\sin(\psi)\sin(\theta))$$

$$l_{221}^2 = a^2 + s_p^2 + z^2 + \left(\frac{b}{2} - x\right)^2 + 2s_p z\sin(\phi)\cos(\theta) + \left(s_p + \frac{b\sqrt{3}}{2} - y\right)^2 +$$

-continued $$2s_p\left(\frac{b}{2}-x\right)(\sin(\psi)\cos(\phi)-\sin(\phi)\sin(\theta)\cos(\psi))-2az\sin(\theta)-$$

$$2a\cos(\psi)\cos(\theta)\left(\frac{b}{2}-x\right)-2a\sin(\psi)\cos(\theta)\left(s_p+\frac{b\sqrt{3}}{2}-y\right)-$$

$$2s_p\left(s_p+\frac{b\sqrt{3}}{2}-y\right)(\cos(\phi)\cos(\psi)+\sin(\phi)\sin(\psi)\sin(\theta))$$

$$I_{220}^2=a^2+s_p^2+z^2+\left(\frac{b}{2}-x\right)^2+\left(s_p+\frac{b\sqrt{3}}{2}+y\right)^2+2a\sin(\psi)\cos(\theta)\left(s_p+\frac{b\sqrt{3}}{2}+y\right)-$$

$$2az\sin(\theta)-2s_pz\sin(\phi)\cos(\theta)-2a\cos(\psi)\cos(\theta)\left(\frac{b}{2}-x\right)-$$

$$2s_p\left(\frac{b}{x}-x\right)(\sin(\psi)\cos(\phi)-\sin(\phi)\sin(\theta)\cos(\psi))-$$

$$2s_p\left(s_p+\frac{b\sqrt{3}}{2}+y\right)(\cos(\phi)\cos(\psi)+\sin(\phi)\sin(\psi)\sin(\theta))$$

$$I_{225_2}=\left(s_p+\frac{a\sqrt{3}}{2}\right)^2+z^2+\left(\frac{b}{2}-x\right)^2+\left(s_p+\frac{b\sqrt{3}}{2}+y\right)^2+$$

$$\frac{a\left(a+4z\sin(\theta)+2\cos(\psi)\cos(\theta)(b-2x)-2\sin(\psi)\cos(\theta)\left(b\sqrt{3}+2s_p+2y\right)\right)}{4}-$$

$$2\left(s_p+\frac{a\sqrt{3}}{2}\right)z\sin(\phi)\cos(\theta)-$$

$$2\left(s_p+\frac{a\sqrt{3}}{2}\right)\left(\frac{b}{2}-x\right)(\sin(\psi)\cos(\phi)-\sin(\phi)\sin(\theta)\cos(\psi))-$$

$$2\left(s_p+\frac{a\sqrt{3}}{2}\right)\left(s_p+\frac{b\sqrt{3}}{2}+y\right)(\cos(\phi)\cos(\psi)+\sin(\phi)\sin(\psi)\sin(\theta))$$

$$I_{223}^2=\left(s_p+\frac{a\sqrt{3}}{2}\right)^2+z^2+(b+x)^2+(s_p+y)^2+2(s_p+$$

$$\frac{a\sqrt{3}}{2}(b+x)(\sin(\psi)\cos(\phi)-\sin(\phi)\sin(\theta)\cos(\psi))+$$

$$\frac{a(a+4z\sin(\theta)-4\sin(\psi)\cos(\theta)(s_p+y)-4\cos(\psi)\cos(\theta)(b+x))}{4}-$$

$$2\left(s_p+\frac{a\sqrt{3}}{2}\right)z\sin(\phi)\cos(\theta)-2(s_p+$$

$$\left(a\frac{\sqrt{3}}{2}\right)(s_p+y)(\cos(\phi)\cos(\psi)+\sin(\phi)\sin(\psi)\sin(\theta))$$

$$I_{224}^2=\left(s_p+\frac{a\sqrt{3}^2}{2}\right)+z^2+(b+x)^2+(s_p-y)^2+2\left(s_p+\frac{a\sqrt{3}}{2}\right)z\sin(\phi)\cos(\theta)-$$

$$2\left(s_p+\frac{a\sqrt{3}}{2}\right)(b+x)(\sin(\psi)\cos(\phi)-\sin(\phi)\sin(\theta)\cos(\psi))-$$

$$2\left(s_p+a\frac{\sqrt{3}}{2}\right)(s_p-y)(\cos(\phi)\cos(\psi)+\sin(\phi)\sin(\psi)\sin(\theta))-$$

$$\frac{a(4\cos(\psi)\cos(\theta)(b+x)-a-4z\sin(\theta)-4\sin(\psi)\cos(\theta)(s_p-y))}{4}$$

| Rotation about | Robotics term | Shipping term | Rotation about | Symbol |
|---|---|---|---|---|
| x | Roll | Trim | i | $\phi$ |
| y | Pitch | List | j | $\theta$ |
| z | Yaw | Skew | k | $\psi$ |

It should be noted that the Euler angles are not the same as the roll, pitch and yawn angles about the x, y and z axis, but can be easily related to them by known homogenous transformations. It should be further noted that the above geometric equations can be used to determine cable length only when all six cables 220 to 225 are in tension, otherwise the head block 15 will not be fully constrained relative to the upper trolley 14.

Also, in order to implement the basic geometric equations in an actual hoist cable drive controller, correction parameters which take into consideration the dimensions of the sheaves and their position/displacement from the ideal arrangement at the apexes of the trapezoids due to mounting considerations, will have to be introduced. This, however, is a routine matter requiring no inventive skill.

Although the above equations are given in general, it should be noted that a choice b=2a will give a geometric configuration where there is no out of plane motion of the head block during hoisting operations, as was indicated above.

For example in the operation of the crane, lengthening of only each of the cables of the first reeving cable pair 220 and 221 by equal amounts will result in a pitch movement of the container only about the longer parallel side of the lower trapezoid 25*a*. If, at the same time, the second and third cable pairs 222, 223 and 224, 225 are simultaneously shortened by an amount smaller than that of the first pair of reeving cables 220 and 221, then this will result in a raising of the head block 15 and hereto attached container along the z-axis and simultaneous pitching of the head block 15 as described.

Thus, the position and attitude of the head block 15 with respect to the trolley 14 can be fully controlled in that proper manipulation of the length of the individual reeving cables 220 to 225 between trolley 14 and head block 15 is effected, while the force and moment applied to the head block 15 via the reeving cables 220 to 225 can be fully controlled by corresponding manipulation of the actual tension applied on individual cables.

As is evident from the above, the symmetry of the reeving arrangement 18 as illustrated in FIG. 6 allows implementation of the single hoisting drum concept illustrated in FIG. 3 and described above. All of the free ends of the six reeving cables 220 to 225 are hereby received on the common hoisting drum 19 whereby a common or non-differential hoisting motion along the z-axis is ensured. The individual rams 26 with displaceable sheaves 27 arranged within the path of each of the reeving cable 220 to 225 provide the mechanism to shorten or lengthen the actual cable path and therefore vary the length of the individual reeving cables to provide for x- and y- axis-positional and pitch, roll and yawn orientational adjustment of the head block 15. It is also possible to use individual hoist drums for each reeving cable, which are independently driven. The embodiment of the hoist drive of the illustration in FIG. 2 uses a combination of two constructional arrangements in that it uses individual hoist drums 19 for individual reeving cables 22, three arranged on each side of the gantry 12, and uses two motors 10, one for each three drum group.

The actual control mechanism for operating the drives and mechanisms to vary the effective length of individual receiving cables utilizing the above given equations such as to obtain the desired movement of the head block 15 with respect to the trolley 14 can be implemented using controller techniques known in the art and will not be described further.

Locating the connecting points of the reeving cables 220 to 225 on the trolley 14 and the head block 15 to coincide as close as possible with the apexes of regular trapezoids 24*a* and 25*a* also increases the stiffness of the hoist as a whole to enable stable transfer of containers 17 having a centre of mass which does not coincide with the geometrical centre of the container. In other words, the allowable area in which the centre of mass of the container may be contained is increased to be located within the lower trapezoid 25*a*, thus allowing for greater centre of mass eccentricity while enabling stable, positional control of the head block 15 with respect to the trolley 14.

The actual spacing distance between the connecting points for the reeving cables at the apexes of the shorter parallel side of the regular trapezoids 24*a* and 25*a* on the trolley support plate 14 and head block 15 (this spacing distance on the trolley support plate and head block being identical and illustrated in FIG. 6 to be 2Sp) can be selected based on the maximum allowable dimension of the trolley 14 in direction of the y-axis (see FIGS. 2 and 3). For example, for a trolley width of 5.0 m, if the spacing distance is chosen to be 12.0 m, then this will result in an allowable eccentricity of centre of mass of approximately 10% for a 12 m container. This value is within the specifications mentioned in the introductory part of the description. This allowable eccentricity increases to 15% for a trolley width of 6 m since it is then possible to increase the spacing distance to 2.2 m.

One of the main advantages of the above described reeving arrangement is that it enables to embody a crane with the ability to change the location (both position and orientation in three dimensions) of the head block (and therefore the load) without moving the trolley, that is, it enables fine positional and attitudinal control. This can be achieved by independently operating the hoist motors or ram mechanisms (see above) to vary the reeving cable lengths to change the lengths of the individual cables suspending the head block. The feasible range of x-(along the gantry) and y-(along the quay) motion of the load at a fixed location of the trolley and head block height (along the z-axis) is governed by the geometry of the reeving arrangement. Assuming a hoist height of 30 m from trolley 14 to head block 15, the range for y- and x-motion of the head block is 0 to approximately 1.2 m and 0 to approximately 1 m, respectively. At a fixed trolley location it is also possible to rotate the load about the vertical z-axis by approximately ±35° without changing the attitude or position of the head block.

A reeving arrangement for the gantry type crane of FIG. 1 incorporating the geometric connections illustrated in FIG. 6 is illustrated in FIG. 7 in a diagrammatic manner. The head block and the trolley have been omitted from the illustration for clarity purposes; however, the sheave and pulley arrangement on the head block and trolley support platform are illustrated in part coinciding with the apexes of respective trapezoids so as to facilitate understanding of the actual reeving configuration. The same reference numerals as in FIG. 6 are used in FIG. 7 to refer to physical reeving cable falls between head block and trolley. As has been described above with reference to FIG. 2, the six reeving cables 220 to 225 are fixed at the boom end of the gantry. The other three ends of the reeving cables 220 to 225 are either received on individual hoist or winch drums or a common hoist drum in a manner previously outlined with reference to FIG. 2 and 3. The cables of the first pair of reeving cables 220 and 221 run along the gantry, one each on opposite sides of the gantry. The cables 220 and 221 enter the sheave and pulley arrangement and engage respective guiding sheaves 320 and 321 on the trolley and are directed toward the head block 15 where they engage with respective return sheaves 420 and 421 located at the ends of the smaller parallel side of the trapezoid (see also FIG. 5) so as to return to the trolley and be directed by secondary guiding sheaves (not illustrated) respectively associated with the guiding sheaves 320 and 321 to exit the hoist. The entry and exit of the respective cables of the first pair 220 and 221 are on the same side of the gantry.

The reeving cables of the second pair 222 and 223 run along either side of the gantry enter the sheave and pulley arrangement. The cables 222 and 223 pass through respective deflection pulleys 522 and 523, via guiding sheaves 322 and 323 (located at the ends of the shorter parallel side of the upper trapezoid) toward return sheaves 422 and 423, respectively, on the head block. The sheaves 422 and 423 are arranged at the ends of the longer parallel side of the lower trapezoid (see also FIG. 5). The cables 222 and 223 return on the same path to engage respective secondary guiding sheaves (not illustrated) associated with the guiding sheaves 322 and 323 from where they pass to be deflected by respective deflection pulleys 522' and 523' to the opposite gantry side. Thus, entry and exit of the cables 222 and 223 of the second pair is on opposite sides of the gantry.

The reeving cables 224 and 225 of the third pair run on either side of the gantry and enter the sheave and pulley arrangement to engage respective guiding sheaves 324 and 325 located at the ends of the longer parallel side of the upper trapezoid. From there, cables 224 and 225 run downwardly to the respective return sheaves 424 and 425 arranged at the ends of the longer parallel side of the lower trapezoid (see also FIG. 5). Thereafter, cables 224 and 225 return along the same path toward the secondary guiding sheaves associated with the guiding sheaves 324 and 325, respectively, where they are deflected to exit toward the boom. Here again, entry and exit of the respective cables 224 and 225 is on the same side of the gantry.

The hoist arrangement (reeving 18 and head block 15) further comprises a sensor system 26 which enables accurate determination of the location of the head block 15, and therefore a container 17 carried by the head block 15, with respect to the trolley 14. To this end, a set of inertial sensors as indicated at reference numeral 29 in FIG. 7 is mounted on the head block 15. The sensors include three gyroscopes and a 3-axial accelerometer (or three individual axial accelerometers arranged perpendicular to one another) for measuring the angular velocity and linear accelerations of the head block 15 in three orthogonal directions x, y and z, and two tilt sensors for measuring the orientation of the load with respect to the horizontal x-y plane. The data compiled by the sensors can be used to calculate the position and attitude of the head block 15 with respect to the trolley 14. This data can be incorporated into the control algorithms used to drive the trolley 14 and hoist drives so as to minimize load sway and accurately position a container carried by the hoisting arrangement. This data can also be used to assist the crane operator to manoeuvre the head block in a controlled and stable manner to engage a container to be loaded or unloaded.

In FIG. 7, in order to provide clarity of illustration of the run of the respective reeving cable pairs, it was necessary to omit illustration of the so-called secondary guiding sheaves; the expression secondary guiding sheaves as used above denotes the "splitting" of the guiding sheaves into two sheave disks which are necessary to deflect the incoming cable to run in a downward direction towards the head block return sheaves and subsequently receive and further guide the upcoming cable to exit the sheave and pulley arrangement of the trolley and run towards the boom end or hoisting drum, as the case may be.

Figure 8:
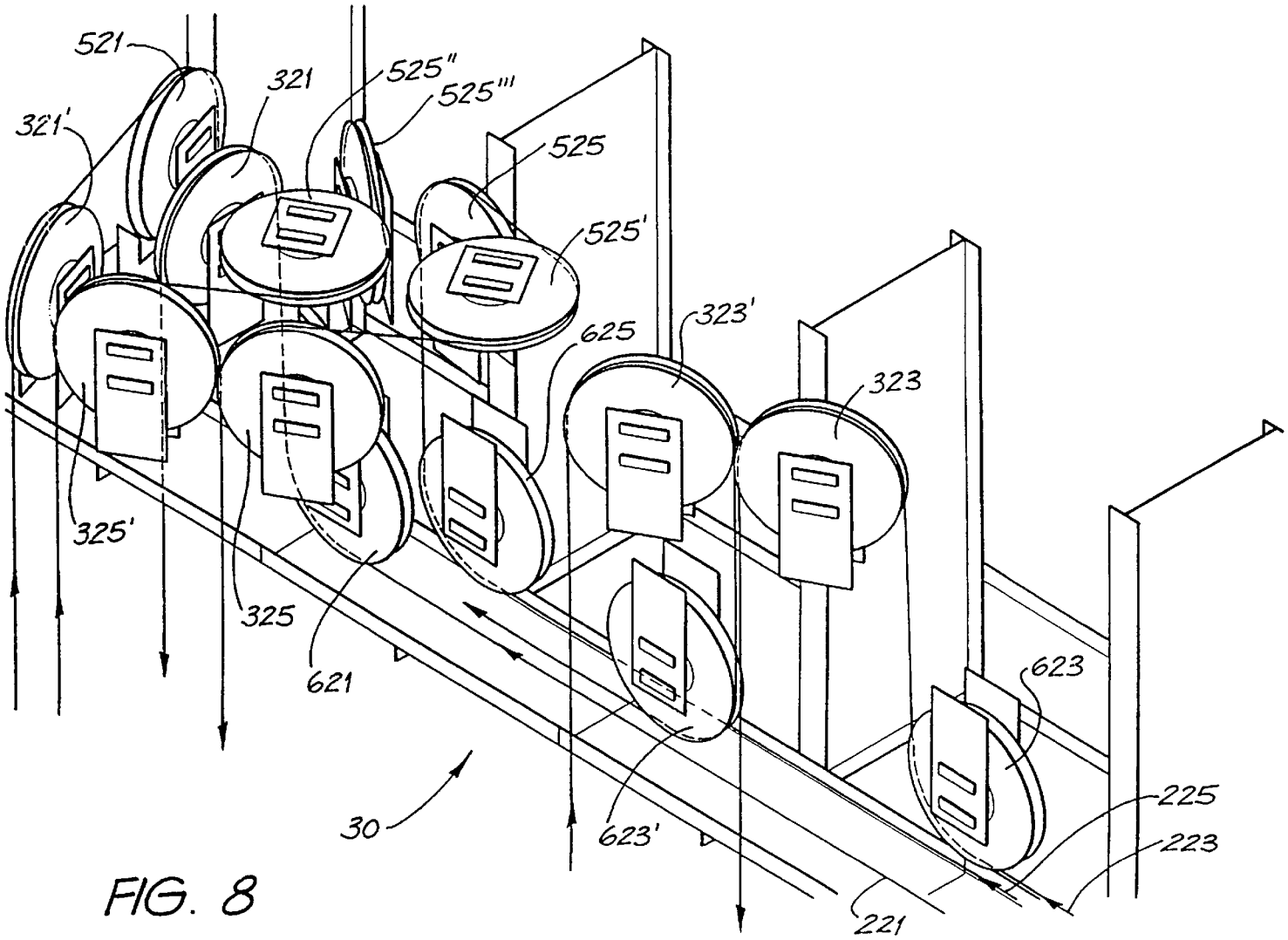
FIG. 8 is a simplified perspective view of sheaves and pulleys on the left hand side of the gantry trolley as illustrated in FIG. 4, and shows the path of individual reeving cables on the left hand of the gantry trolley, the right hand sheave arrangement being mirror symmetrical to the left hand.

This can be better understood by having reference to FIGS. 4 and 8 in which an actual arrangement of sheaves and pulleys used to guide and deflect the hoisting cables on the upper gantry trolley 14 is illustrated. The illustrated sheave and pulley arrangement is somewhat different from the one previously described with reference to FIG. 7 in that entry and exit of reeving cables into the sheave and pulley arrangement is always on the same side of the gantry. That is, the crossover of cable runs mentioned above with reference to the second pair of reeving cables does not take place. It will be further noted that the actual gantry trolley 14 illustrated in FIG. 4 has a mirror symmetrical design about the longitudinal axis extending in x-direction, and therefore the run of reeving cables on the sheave and pulley arrangement illustrated on the left hand side will be mirror symmetrical to the one illustrated on the right hand side.

As can be seen in FIG. 4, the gantry trolley 14 incorporates two main support beams or boxes 142 which are arranged parallel to one another and respectively support at opposite distal ends one carriage 144 by means of which the trolley is supported on guiding beams of the gantry 12 such as to allow translatory movement in direction of axis x along the gantry extension. A total of four downward extending support arms 146 join two support platform halves 140 to respective one of the support beams 142. Two bracing beams 148 disposed on the underside of the support forms 140 braise and interconnect the trolley structure to provide the required structural rigidity.

The arrangement of guiding sheaves and deflection and guide pulleys is generally indicated at 30. Some of the pulley/sheave disks are supported for rotation about horizontally extending axes and some about vertical axes on respective mounting arms, two exendary being indicated at 31, which are fixedly mounted on the support platforms 140 in an arrangement dictated by the above mentioned geometrical reeving configuration and the necessity to avoid collision of cable runs.

In contrast to the trolley structure, the head block 15 illustrated in FIG. 5 can be a rather simple support structure comprised of a number of struts and beams 150 which support plate members 152 which themselves support bearings for the return sheaves 420–425 provided in the trapezoid arrangement previously described.

Reverting to FIG. 4, while not illustrated, one each of the reeving cables of the three pairs of cables will run on the left hand side and the other three cables of the three pairs run on the right hand side through the pulley and sheave arrangement of the trolley 14. This can be better understood by having reference to FIG. 8. There is illustrated almost in its entirety, the run of the cables received on the left hand side of the trolley. To aid in the visualization of the arrangement, the actual supporting platform 140 has been omitted to clearly show the arrangement of guide pulleys on the lower part of the supporting platform and the arrangement of pulleys and sheaves on the upper part of the supporting platform on which they are rotatably mounted. It can also be noted that all guide pulleys arranged on the lower part of the support platform 140 are preceded by the number 6; deflection pulleys arranged on the upper part of the support platform are preceded by the number 5; and the guiding sheaves which serve to direct the reeving cables in a downward direction and receive the returning cable run from the not illustrated block head are preceded by the number 3. The last two numerals used to distinguish the individual sheaves and pulleys corresponds to the last two digits of the reference numeral used to identify an individual reeving cables 221, 223 and 225.

The three reeving cables 221, 223 and 225 enter the sheave and pulley arrangement from the lower right hand side of the drawing plane and leave the arrangement towards the upper left hand corner. Thus, reeving cable 221 enters from the lower side of the trolley and engages guide pulley 621 from where it passes towards the upper part of support plate to directly be received by guiding sheave 321 and be directed downwards towards the head block. Due to the perspective illustration of FIG. 8, it is not clearly apparent but it is to be understood that guiding sheave 321 is arranged near an apex of the longer parallel side of the upper trapezoid in similar manner as illustrated in FIG. 7. Reeving cable 221 is received on return sheave 421 of the head block illustrated in FIG. 5 and returned in an upward direction to be received at guiding sheave 321', which in the above given description with reference to FIG. 7 is called a secondary guiding sheave. Reeving cable 221 then passes through guiding pulley 521 where it is deflected in a downward direction to a not illustrated further guiding pulley arranged on the lower side of the trolley to exit the arrangement in the manner outlined above.

Reeving cable 223 enters the arrangement to be deflected at lower guiding pulley 623 to be directed in an upward direction to guiding sheave 323 from where the reeving cable 223 runs downward towards the head block. Cable 223 is returned at guide sheave 423 to run in an upward direction and then to be received at guiding sheave 323' from where it is directed again downwards to lower a guiding pulley 623' and subsequently redirected to exit the pulley arrangement towards the left hand corner of the illustration. Guiding sheaves 323 are located near the apex of the shorter side of the upper trapezium.

Finally, reeving cable 225 enters the pulley arrangement to engage lower guiding pulley 625 to be passed to the upper side of the trolley and engage guiding pulley 525. Reeving cable 225 then passes to a guiding pulley 525' having a rotation axis substantially extending in a vertical direction. Reeving cable 225 is subsequently deflected toward guiding sheave 325 to be directed in a downward direction towards the return sheave 425 at the head block from where it returns in an upward direction to engage guiding sheave 325'. Subsequently, reeving cable 225 is deflected by means of a horizontally rotating guiding pulley 525" towards deflection pulley 525'" which directs the cable in an not illustrated manner towards the lower part of the trolley where it engages a not illustrated lower guiding pulley to exit the sheave arrangement.

The above described reeving configuration for a crane embodiment allows stable and controlled manipulation of the head block 15 with respect to the trolley 14. Thus, fine positioning of the head block 15 can be achieved to pick-up a container once gross-positional adjustment of the trolley 14 and herefrom suspended head block 15 has been accomplished. The proposed reeving arrangement 18 also provides potential for active anti-sway and damping control since the reeving arrangement 18 can be manipulated to respond in a stable, predetermined, manner to counter any forces which will induce load sway.

Finally, while the above described reeving cable configuration illustrates to have two falls per reeving cable, it will be appreciated that crane embodiments are imaginable, in which the ends of the six reeving cables are actually fixedly received on appropriate mounts on the head block, instead of the boom end of the crane. Then, the sheave and pulley arrangement will be greatly simplified and only one fall per cable will be present between upper support structure and head block.

We claim:

1. A crane comprising:

an upper support structure;

a lower support structure arranged to carry a load;

six reeving cables extending between said upper and lower support structures, said cables suspending said lower support structure from said upper support structure; and means for changing an effective length between said upper and lower support structures of selected ones of said reeving cables, said reeving cables being connected geometrically to said upper and lower support structures at apexes of respective quadrilateral plane figures, and said reeving cables being arranged so that the cables of a first pair of said reeving cables converge toward one another in a downward direction from said upper support structure to said lower support structure, the cables of a second pair of said reeving cables converge toward one another in an upward direction from said lower support structure to said upper support structure, and the cables of a third pair of said reeving cables extending from one end of said first pair of reeving cables to one end of said second pair of reeving cables.

2. A crane in accordance with claim 1, wherein said reeving cables are connected to said upper support structure by connections located to conincide geometrically with the apexes of trapezoids.

3. A crane in accordance with claim 2, wherein said reeving cables are connected to said upper and lower support structures by connections located to coincide geometrically with the apexes of regular trapezoids having parallel sides of unequal length and non-parallel sides of equal length.

4. A crane in accordance with claim 3, wherein a distance along a shorter parallel side of said regular trapezoid that is associated with said upper support structure is equal to a distance along the shorter parallel side of said trapezoid that is associated with said lower support structure, wherein a distance along a longer parallel side of said trapezoid associated with said lower support structure being equal to a distance along the shorter parallel side plus a distance equal to $\sqrt{3a}$, where a is a radius of a circle circumscribing an equilateral triangle with a side length equal to a length of the non-parallel sides of said trapezoid associated with said lower support structure, and a distance along the longer parallel side of said trapezoid associated with said upper support structure is equal to the distance along the shorter parallel side plus a distance equal to $2\sqrt{3b}$, where b is a radius of a circle circumscribing an equilateral triangle with a side length equal to the length of the non-parallel sides of the trapezoid associated with said upper support structure.

5. A crane in accordance with claim 3, further comprising an electronic controller arranged to provide control commands that are operative on said means for changing the effective length of said reeving cables in accordance with geometric equations linking the three-dimensional spatial attitude of said lower support structure to effective distances between the apexes of the trapezoids at said lower and upper support structures so as to adjust and maintain a predetermined length and tension in each of said reeving cables required by the spatial attitude.

6. A crane in accordance with claim 5, further comprising sensor means for determining the spatial attitude of said lower support structure with respect to said upper support structure.

7. A crane in accordance with claim 6, further comprising feedback means arranged to transmit to said electronic controller a position and orientation in space of said lower support structure with respect to said upper support structure as determined by said sensor means, said electronic controller being arranged to generate command signals to effect fine adjustment of the position and orientation of said lower support structure in response to feedback data provided by said feedback means.

8. A crane in accordance with claim 7, wherein said means for changing the effective length of said reeving cables are operated to automatically counter externally applied forces to the load carried by said lower support structure.

9. A crane in accordance with claim 6, wherein said sensor means comprises an inertial platform of gyroscopes and accelerometers disposed on said lower support structure.

10. A crane in accordance with claim 1, wherein an area of the quadrilateral plane figure defined geometrically by connections between said reeving cables and said upper support structure is larger than an area of the quadrilateral plane figure defined geometrically by the connections between said reeving cables and said lower support structure.

11. A crane in accordance with claim 1 constructed as a gantry type crane for hoisting containers, wherein said upper support structure comprises a trolley arranged for reciprocating linear movement along a gantry or boom structure of said crane, and said lower support structure comprises a head block to which said container is in use coupled by a spreader.

12. A crane in accordance with claim 1, wherein said means for changing the effective length of said reeving cables between said upper and lower support structures comprise a plurality of hoist drums, one hoist drum being provided for each of said reeving cables.

13. A crane in accordance with claim 12, wherein said hoist drums are driven by individual motors to effect fine attitudinal control of said lower support structure with respect to said upper support structure.

14. A crane in accordance with claim 13, wherein said hoist drums are driven by a common motor.

15. A crane in accordance with claim 14, further comprising a transmission system interposed between said motor and said plural hoist drums, said transmission system being arranged to effect differential movement of individual hoist drums.

16. A crane in accordance with claim 1, wherein said means for changing the effective length of each of said reeving cables between said upper and lower support structures comprises a single motor driven hoist drum for all of said reeving cables.

17. A crane in accordance with claim 16, wherein said adjusting means comprises one of electric, hydraulic and pneumatically activated rams which incorporate cable guiding elements.

18. A crane in accordance with claim 16, further comprising adjusting means located in a path of each reeving cable to provide for additional individual adjustment of the lengths of each of said reeving cables.

19. A crane in accordance with claim 1, wherein said reeving cables are connected to said lower support structure by connections located to coincide geometrically with the apexes of trapezoids.

* * * * *